US010280536B2

(12) United States Patent
Nimmo, Sr.

(10) Patent No.: US 10,280,536 B2
(45) Date of Patent: May 7, 2019

(54) SPRAYING WATER ON GINNED COTTON

(71) Applicants: Micro Dryer, LLC, Corpus Christi, TX (US); Caroline Marie Nimmo, Lemoore, CA (US)

(72) Inventor: Ronnie Joe Nimmo, Sr., Lemore, CA (US)

(73) Assignee: MICRO DRYER, LLC, Corpus Christi, TX (US)

( * ) Notice: Subject to any disclaimer, the term of this patent is extended or adjusted under 35 U.S.C. 154(b) by 392 days.

(21) Appl. No.: 14/999,434

(22) Filed: May 3, 2016

(65) Prior Publication Data

US 2016/0340805 A1 Nov. 24, 2016

Related U.S. Application Data

(60) Provisional application No. 62/179,452, filed on May 6, 2015.

(51) Int. Cl.
*D01G 99/00* (2010.01)

(52) U.S. Cl.
CPC ..... *D01G 99/005* (2013.01)

(58) Field of Classification Search
CPC ..... D01G 99/005
USPC ..... 19/66 R, 66 CC
See application file for complete search history.

(56) References Cited

U.S. PATENT DOCUMENTS 1,954,383 A * 4/1934 Herring ..... D01G 99/005 19/39
2,178,539 A 11/1939 Hill
2,764,013 A 9/1956 Harrell
2,815,536 A * 12/1957 Bryant ..... D01G 99/005 19/39
2,834,058 A * 5/1958 Bryant ..... D01G 99/005 19/39
2,932,857 A * 4/1960 Smith ..... D01G 99/005 19/0.27
3,114,175 A * 12/1963 Bryant ..... D01G 99/005 19/39
3,114,938 A * 12/1963 Bryant ..... D01G 99/005 19/39
3,247,552 A * 4/1966 Bryant ..... D01G 99/005 19/39
3,717,904 A 2/1973 Bonner
3,834,869 A 9/1974 Ancelle
4,019,225 A 4/1977 Nayfa
4,021,887 A * 5/1977 Jackson ..... D01B 1/04 19/39

(Continued)

*Primary Examiner* — Shaun R Hurley
(74) *Attorney, Agent, or Firm* — G. Turner Moller

(57) ABSTRACT

In a cotton gin, water is sprayed into a duct transporting pneumatically conveyed cotton fibers from a gin stand toward a battery condenser to improve the operation of a bale press where the ginned fibers are compacted into a bale. In some embodiments, a taggant is incorporated into the water to mark cotton fibers so threads or fabrics made from the cotton can be identified for quality control purposes. Spray nozzles may deliver water droplets of roughly the same size as the diameter of the cotton fibers. The nozzles may be located on a duct in a location adjacent dead air in the duct to promote coverage of the spray onto the cotton stream. Air may be delivered around the nozzles into the duct to prevent buildup of cotton and debris around the nozzles.

21 Claims, 4 Drawing Sheets

(56) References Cited

U.S. PATENT DOCUMENTS

| | | | | |
|---|---|---|---|---|
| 4,074,546 | A | 2/1978 | Roberson | |
| 4,103,397 | A * | 8/1978 | Jackson | D01B 1/04 100/74 |
| 4,726,096 | A * | 2/1988 | Woods, Jr. | D01G 99/005 19/0.21 |
| 5,381,587 | A * | 1/1995 | Vandergriff | D01B 1/06 19/48 R |
| 6,202,258 | B1 * | 3/2001 | Winn | D01B 1/04 19/39 |
| 6,237,195 | B1 | 5/2001 | Shoemaker | |
| 6,240,601 | B1 | 6/2001 | Kiser | |
| 6,314,618 | B1 | 11/2001 | Mehner | |
| 6,389,647 | B1 * | 5/2002 | Lewis | D01G 99/005 19/66 CC |
| 6,807,750 | B1 | 10/2004 | Lewis | |
| 7,591,048 | B2 | 9/2009 | Mehner | |
| 7,912,653 | B1 | 3/2011 | Scher et al. | |
| 8,091,181 | B2 * | 1/2012 | Van Doorn | D01G 99/005 19/66 CC |
| 2009/0100643 | A1 * | 4/2009 | Mehner | D01B 1/02 19/48 R |
| 2009/0249582 | A1 * | 10/2009 | Van Doorn | D01B 1/04 19/66 CC |
| 2014/0106357 | A1 | 4/2014 | Berrada | |
| 2016/0168781 | A1 * | 6/2016 | Tran | D01B 1/04 435/6.12 |

* cited by examiner

SPRAYING WATER ON GINNED COTTON

This application is based on Provisional Patent Application 62/179,452, filed May 6, 2015, priority of which is claimed and which is incorporated herein by reference.

0.5 This invention relates to a technique for hydrating ginned cotton in a cotton gin.

BACKGROUND OF THE INVENTION

In order to improve operation of gin stands in the ginning of cotton, seed cotton is dried to reduce the water content to low single digits at a location upstream of gin stands where seeds are removed from lint.

Low water content also helps lint cleaners upstream and downstream of the gin stands to separate seed cotton or cotton from dust and plant parts. Before the lint passes into a bale press, it is desirable to rehumidify the cotton lint so the bale press works efficiently—very dry cotton lint tends to rebound when the bale press retracts.

A typical gin includes a conduit or duct delivering cotton and propelling air from the gin stands through a downstream cleaner into a battery condenser where a screen allows air to escape thereby forming a cotton batt which slides by gravity down a lint slide into the bale press. The standard technique for rehumidifying cotton is to deliver high humidity air through the bottom of the lint slide so it passes upwardly through the batt whereby some or all of the water condenses on the cotton fibers.

Large modern commercial gins run about 60 bales/hour while small gins deliver at least 15 bales/hour. A bale is about 500 pounds of lint so the amount of cotton sliding down the lint slide may be in the range of 7500-30,000 pounds per hour or 2-8 pounds per second. One can imagine that getting a substantially uniform dispersion of condensed water on the batt with current equipment is unlikely.

It has been attempted in the prior art to spray a water taggant solution on a cotton batt as it slides down the lint slide. The results were not satisfactory because the taggant was not found on a disappointingly large fraction of cotton fibers.

Disclosures of some interest relative to this invention are found in U.S. Pat. Nos. 2,178,539; 2,764,013; 3,717,904; 3,834,869; 4,019,225; 4,074,546; 6,237,195; 6,240,601; 6,314,618; 6,389,647; 6,807,750; 7,591,048; 7,912,653 and 8,091,181 and U.S. Printed Patent Application 2014/0106357.

SUMMARY OF THE INVENTION

As disclosed herein, water is sprayed into an air duct downstream of the gin stands and upstream of the battery condenser while the cotton fibers are being pneumatically transported toward the battery condenser, i.e. while the cotton fibers are suspended in propulsion air. A mind's eye picture of the cotton/air mixture flowing through the duct is analogous to the worst imaginable blizzard. Flow through the duct may be relatively fast, e.g. 1500-2000'/minute or 25-34' per second. The amount of cotton flowing through the duct varies, of course, with the capacity of the gin but for common gins is in the range of 2-8 pounds per second. A nozzle assembly is designed to produce water droplets that are of a diameter that is the same order of magnitude than the diameter of ginned cotton fibers.

It is an object of this invention to provide an improved technique for rehumidifying cotton lint upstream of a bale press.

A more specific object of this invention is to provide a technique for rehumidifying cotton lint upstream of a bale press in a manner that produces uncommonly consistent dispersion of liquid water onto cotton fibers.

A further object of this invention is to provide an improved technique for tagging cotton fibers with a material that can later be detected.

Another object of this invention is to spray water and a solution onto cotton fibers upstream of a bale press.

These and other objects of this invention will become more fully apparent as this description proceeds.

DETAILED DESCRIPTION OF THE INVENTION

Figure 1:
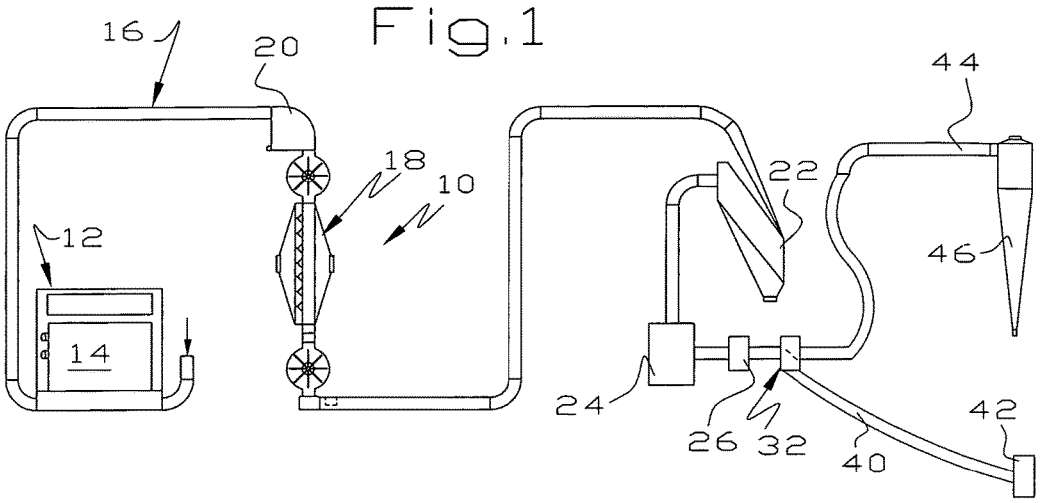
FIG. 1 is a schematic view of a cotton gin.

Referring to FIGS. 1-4, a cotton gin 10 may comprise, as major components, a module feeder 12 for disintegrating a cotton module 14, a transport system 16 for delivering cotton clumps from the module feeder 12 through the various components of the gin 30. Cotton gins 10 typically include a feed controller 18, a series of separators or cleaners 20, 22 for separating seed cotton or cotton lint from plant debris upstream from one or more gin stands 24 which separate cotton seed from lint. A cleaner 26 downstream of the gin stands 24 may remove any residual dust or plant parts.

Conveying air introduced in a conventional manner downstream of the gin stands 24 delivers cotton fibers through the cleaner 26 and through a duct 28 leading to a battery condenser 32. The duct 28 may be a wide rectangular duct which necks down through a transition 30 to a round duct 34. Inside the battery condenser 32 is a screen 36 or other suitable means for separating conveying air flow cotton lint and producing a cotton batt 38. The cotton batt 38 slides by gravity along a lint slide 40 into to a bale press 42 where the ginned cotton is compressed into a gin bale.

Conveying air from the battery condenser 32 passes through a conduit 44 to one or more cyclones 46 for removing dust from the conveying air before exhausting it to the atmosphere. Those skilled in the art will recognize the gin 10 as heretofore described as being typical of modern commercial gins. The disclosures of U.S. Pat. Nos. 8,046, 877 and 8,356,389 are incorporated herein by reference for a more complete description of a cotton gin.

As will be explained more fully hereinafter, a series of nozzle assemblies 48 delivers a water spray into the duct 28 at one or more locations downstream of the gin stands 24, such as between the gin stands 24 and the lint cleaner 26 or between the lint cleaner 26 and the battery condenser 32. Downstream of the lint cleaner 26 may be preferred because many lint cleaners are more efficient with drier cotton lint. The water spray may preferably be into the duct 28 upstream of the battery condenser 32 or into the battery condenser 32 upstream of the screen 36 or other device to separate propulsion air from ginned cotton fibers. It may be preferred to have the nozzle assemblies 48 spraying water into the wide rectangular duct 28 because the cotton fibers are traveling at a lower speed than in the smaller round duct 34 where velocities are higher thereby promoting more consistent dispersion of water droplets onto the cotton lint.

Figure 3:
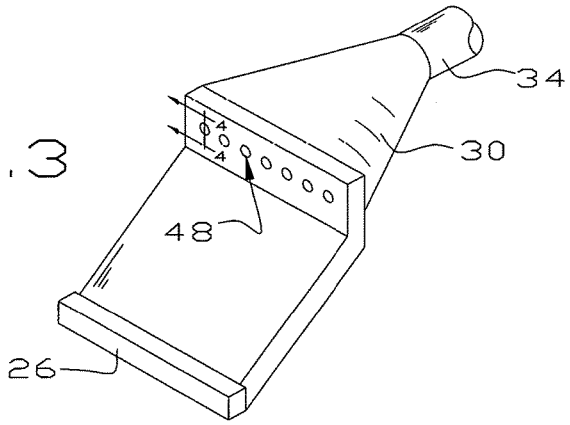
FIG. 3 is an isometric view of the cleaner of FIG. 2 and conduit connecting the cleaner with the battery condenser.

Another advantage of spraying into the wide rectangular duct 28 is there is considerably more room for a large number of nozzle assemblies 48 as compared to the smaller round duct 34 as may be visualized in FIG. 3. A further advantage of spraying into the wide rectangular duct 28 is the cotton fibers are more widely separated than in the round duct 34. For example, saws (not shown) in the cleaner 24 act to separate cotton fibers to allow trash and dust to separate from the fibers and the cotton fibers have not had the opportunity to conglomerate as may occur in the smaller round duct 34. The direction of water spray may be transverse to the direction of cotton flow to minimize cotton fibers aimed directly at the nozzle assemblies 48. It may be preferred that water spray is generally perpendicular or obtuse to the direction of cotton flow. FIG. 3 is a schematic view of a prototype installation in a working gin and suggests that the rectangular duct 28 is upwardly inclined but this was done to provide adequate room for the spray equipment in an existing gin configuration. As explained more fully hereinafter, many different duct work configurations are feasible.

Figure 4:
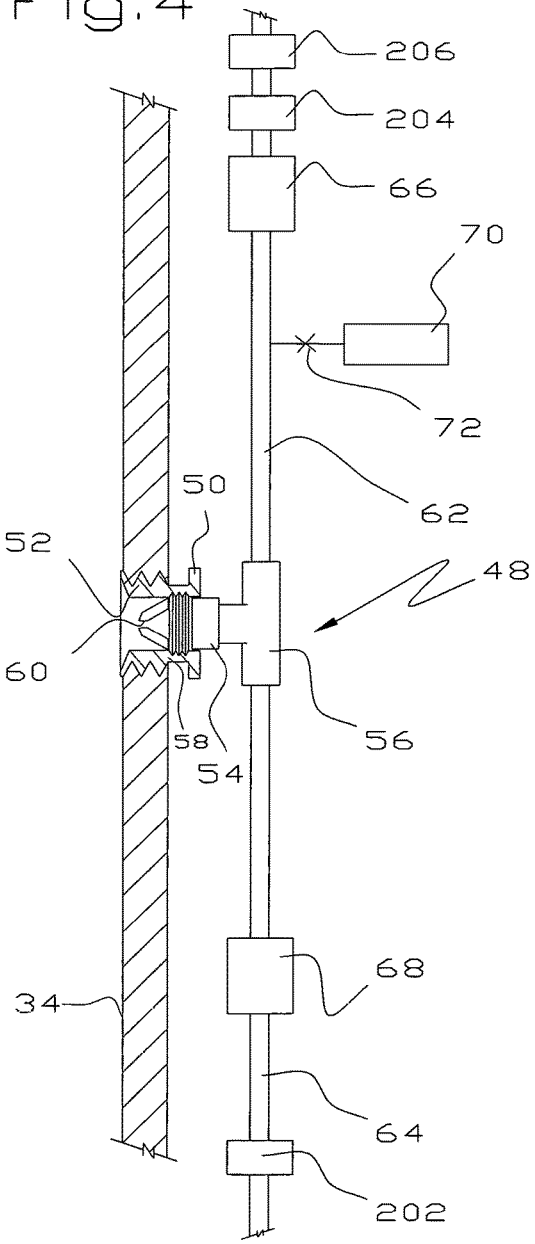
FIG. 4 is a cross-sectional view of FIG. 3, taken along line 4-4 thereof as viewed in the direction indicated by the arrows to illustrate a nozzle assembly used to rehumidify cotton lint.

Referring to FIG. 4, each nozzle assembly 48 may comprise a a fitting 50 securing the assembly 48 in any conventional manner in a threaded opening 52 in the duct 28. The fitting 50 may accordingly comprise an externally and internally threaded bushing receiving an externally threaded nozzle 54 to which is attached a manifold 56. The nozzle opening 52 may preferably be recessed inside the fitting 30 out of the flow diameter of the duct 28, i.e. outward of the internal dimension of the duct 28, to avoid collecting cotton lint on the nozzle 54 and thereby avoiding wet masses of cotton collecting on or clinging to the nozzle 54. Another technique which may be effective to avoid the accumulation of wet cotton fibers on the nozzle 54 is to provide one or more air leakage passages 58 through the fitting 50 to allow air to be drawn into the recessed cavity adjacent the nozzle end 60. This acts to dislodge any wet cotton fibers from the nozzle 54 or prevent their accumulation.

The nozzle 54 is connected to a water supply line 62 and an air supply line 64. An oddity of the nozzle 54 is that it is capable of delivering very small droplets in the range of 5-25 micron diameter microns which is about the same size as the width or diameter of many cotton fibers. Preferably, the water droplets may be in the range of 5-25 microns and which may preferably be about 8-12 microns in diameter and which may practically be about 10 microns in diameter. Cotton fibers may vary somewhat in diameter but this variation will likely be in the range of 7-22 microns. As pointed out more fully hereinafter, it is believed the size of the water droplets being about the same diameter as the width of the cotton fibers promotes the efficiency of contacting fibers with water droplets.

The nozzle assemblies 48 can be purchased commercially from such companies as Spray.com of Wheaton, Ill. By controlling the water pressure to the assembly 48 with a regulator 66 and controlling the air pressure at the assembly 48 with a regulator 68, the size of droplets emitting from the nozzle 54 and the rate of water delivery can be controlled in a conventional manner, i.e. a table may be provided by the manufacturer so that if water pressure is selected and air pressure is selected, the droplet size and water quantity can be dictated.

Figure 2:
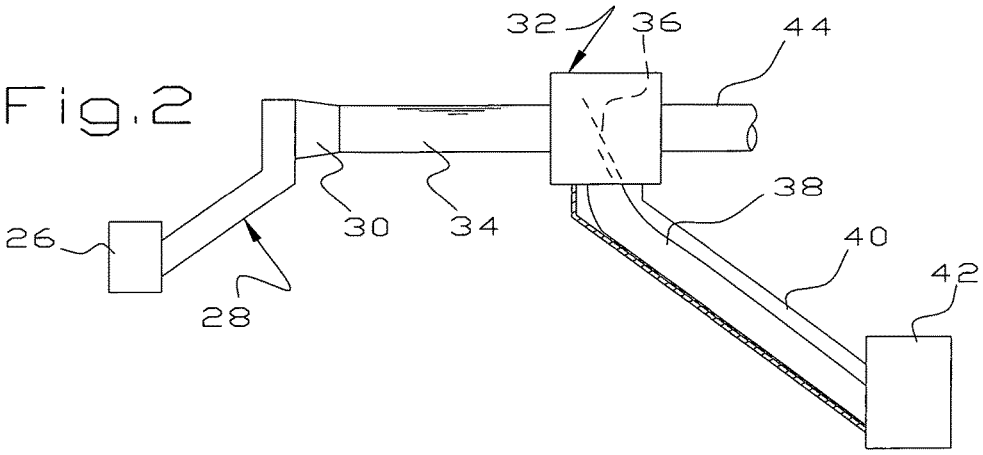
FIG. 2 is a schematic view of a cleaner downstream of gin stands, a battery condenser, a lint slide and a bale press.

To test how consistent water is applied to cotton fibers with the device of FIGS. 2-4, a large batch of Pima cotton of fiber lengths in the range of 1.26-1.47 inches was run through a conventional gin 10 and a taggant was delivered through the conduit 62 along with water. The taggant was from a container 70 and the flow rate of the taggant was controlled by an electrically operated valve or flow meter 72. It will be evident that the pressure regulators 66, 68, valves (not shown) on the water and air lines 62, 64, and the valve 72 may be controlled by a computer (not shown). This allows the taggant to be shut off when cotton flow ceases and matches the amount of taggant delivered through the conduit 62 to the amount of cotton fibers flowing through the duct 28. A computer controller also allows control over the total amount of water in a gin bale by determining the amount of moisture in cotton upstream of the spray nuzzles, the amount of cotton flowing through the duct and the amount of water being sprayed. The amount of water in the gin bale may accordingly be controlled to be less than limits imposed by customers, industry standards or the like, which limit is currently around 7% by weight.

Such a taggant may be of any suitable type but, in the test, artificial DNA was used. The DNA taggant was from Applied DNA Science of Stony Brook, N.Y. Thirty two milliliters of DNA in a total of one liter of DNA/water solution was injected per minute into the water conduit 62 and sprayed into the duct 28 in a gin delivering 20 bales/hour of Pima cotton. Thus, 1920 milliliters/hour of the DNA solution was sprayed onto 20 bales/hour or approximately 10,000 pounds/hour of Pima cotton. The DNA solution was diluted by a substantial amount of water, as explained more fully hereinafter, meaning that the concentration of DNA in the DNA solution is susceptible of wide variation because it will be diluted significantly in the spraying operation.

At a rate of about 350 bales/day, a total of about 10,000 bales of cotton were sprayed with the DNA solution. A total of twelve fiber samples per day were delivered to a laboratory to determine whether the DNA taggant was present on the fiber or a total of about 350 fiber samples. 100% of the fiber samples submitted to the laboratory tested positive for the DNA taggant, Meaning that every tooted fiber had contacted a water droplet. This is difficult for knowledgeable cotton gin people to believe because the number of individual fibers in 10,000 bales of cotton is immense, almost beyond imagination. This is not proof that every fiber in the 10,000 bales had been contacted with water but sophisticated statistical calculations will show, to a very high degree of confidence, that a very large proportion of fibers were contacted with DNA laced water. The exact mechanism that distributes taggant so efficiently is not known and the invention is not bound by any theory. One may surmise that some of the fibers were contacted directly by sprayed taggant but it is not known that all of the tested fibers were contacted directly by sprayed taggant. It is possible that taggant was transferred indirectly to some fibers by a tagged fiber rubbing against an untagged fiber. Given the turmoil of fibers jostling along in a propulsion air stream, this seems possible and perhaps likely.

It is apparent this technique is a viable approach to mark fibers, including cotton fibers, in a quality control effort. Tagging a select type of cotton fibers with DNA taggants can readily assure that the select type of fibers is present in processed threads or textiles. In addition, it is clearly feasible to spray water onto ginned cotton upstream of a battery condenser with a penetrant, other than a taggant or marker, that has beneficial effects on cotton fibers. The penetrant may be of any suitable type such as a surfactant, wetting agent or the like.

Another advantage of this invention is that it is much, much cheaper than conventional rehumidifying equipment. The only cost are some commercially available nozzles, a water source, a source of low pressure air, conventional low pressure regulators, valves, a computer controller and the labor to install the equipment. The required water pressure in most applications is well below the pressure of conventional city water systems, meaning that no additional water pumping equipment is necessary.

Figure 5:
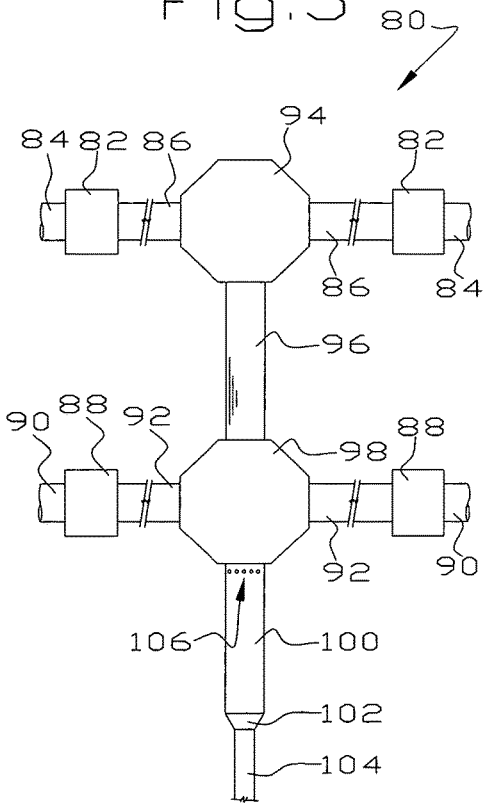
FIG. 5 is a schematic view of part of a modern gin showing another arrangement of duct work downstream of a cleaner that is, in turn, downstream of gin stands.

Referring to FIG. 5, there is illustrated a cotton gin 80 having a differently configured ducting arrangement downstream from a first plurality of cleaners 82 each of which includes an inlet 84 and an outlet 86 which may typically be a rectangular duct similar to the duct 28. A second plurality of cleaners 88 may be provided which includes an inlet 90 and an outlet 92 which typically may be a rectangular duct similar to the duct 28. Outlets 86 of the first cleaners 82 may be connected to a valve 94 which may connect one or both of the outlets 86 to an intermediate duct 96 which connects to a second valve 98 which typically may be connected to the outlets 92 of the second cleaners 88. An outlet conduit 100, which may be rectangular similar to the duct 28, from the valve 98 may deliver cotton pneumatically conveyed through the valves 94, 98 through a transition 102 to a round duct 104 leading to a battery condenser (not shown) in a manner similar to the gin 10 in FIGS. 1 and 2. The gin 80 as heretofore described will be understood by those skilled in the art to be representative of modern high capacity gins where one or a plurality of the cleaners 82, 88 may be operating, depending on the volume throughput of the gin 80 and as controlled by the position of the valves 94, 98.

A series of nozzle assemblies 106 delivers a water spray into the duct 100 at one or more locations downstream of the cleaners 82, 88. It may be preferred to have the nozzle assemblies 108 spraying water into the wide rectangular duct 100 rather than into the round duct 104 for the same reasons it may be desirable to spray water into the rectangular duct 28 rather than the round duct 32.

Figure 6:
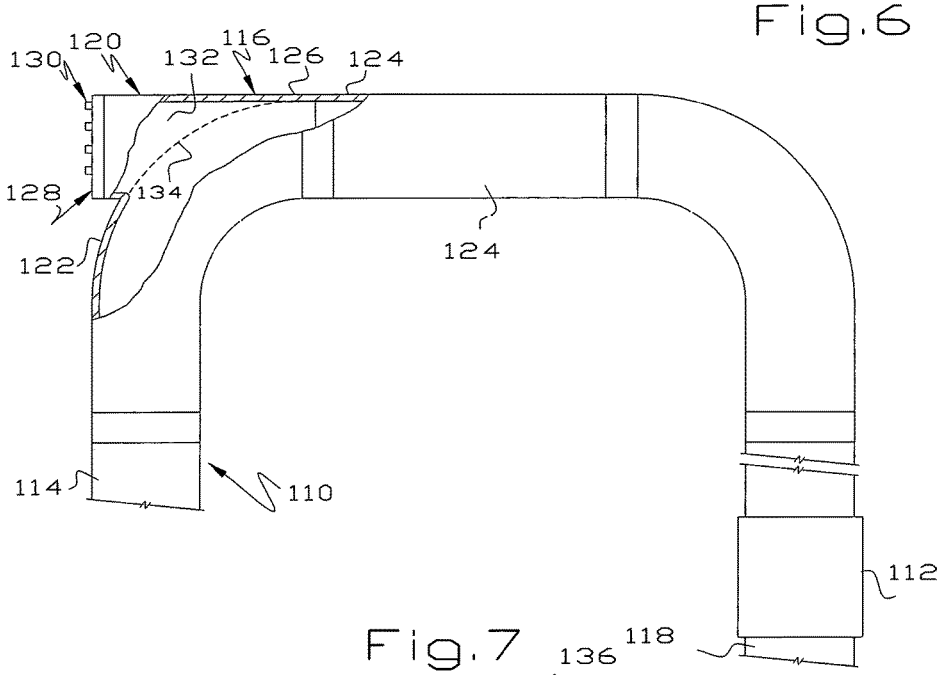
FIG. 6 is a broken view of another embodiment of a duct and nozzle array.

Referring to FIG. 6, another embodiment of this invention is illustrated comprising a duct 110 at some location in a cotton gin, such as shown in FIG. 1, between the gin stands (not shown) and a lint cleaner (not shown), between the lint cleaner (not shown) and a battery condenser 112 or between the gin stands (not shown) and the battery condenser 112 if no lint cleaner is present. The duct 110 may be rectangular or round and includes an inlet 114, one or more elbows or bends 116 and an outlet 118 leading to a bale press (not shown). The duct 110 can be horizontal or vertical, meaning that the elbow 116 may change the direction of the duct 110 in a horizontal plane, in a vertical plane or in an inclined plane. The elbow 116 changes the direction of lint flow and an includes an intersecting pipe section or access hatch 120. The access hatch 120 comprises a curved inlet wall 122 of a thickness similar to the wall 124 of the duct 110 and a straight outlet wall 126 and normally include a hatch cover (not shown) which has been replaced by a nozzle array 128 having thereon a series of nozzle assemblies 130. One effect of the access hatch 120 is to create a dead air space 132.

It may be advantageous to spray water into the dead air space 132 for a variety of reasons. Pressure in the dead air space 132 is lower than atmospheric pressure because of the change of direction of lint flow. This allows outside air to flow, without a fan or pump, past the nozzle assemblies 130 to dislodge cotton or water collecting, or tending to collect, on the nozzle assemblies 130 as will be pointed out more fully hereinafter. Another aspect of the dead air space 132 is that lint flow detaches from the wall 122 along a line or zone 134 leaving the space 132 mostly free of cotton. This allows spray from the nozzle assemblies 130 to spread out before contacting any cotton thereby increasing the ability of the spray to reach most or all of the cotton fibers. Another advantage of the dead air space 132 is to allow ambient air to enter the duct 110 and thereby flow past the nozzle assemblies 130 in order to dislodge or prevent the accumulation of debris on the assemblies 130.

Figure 7:
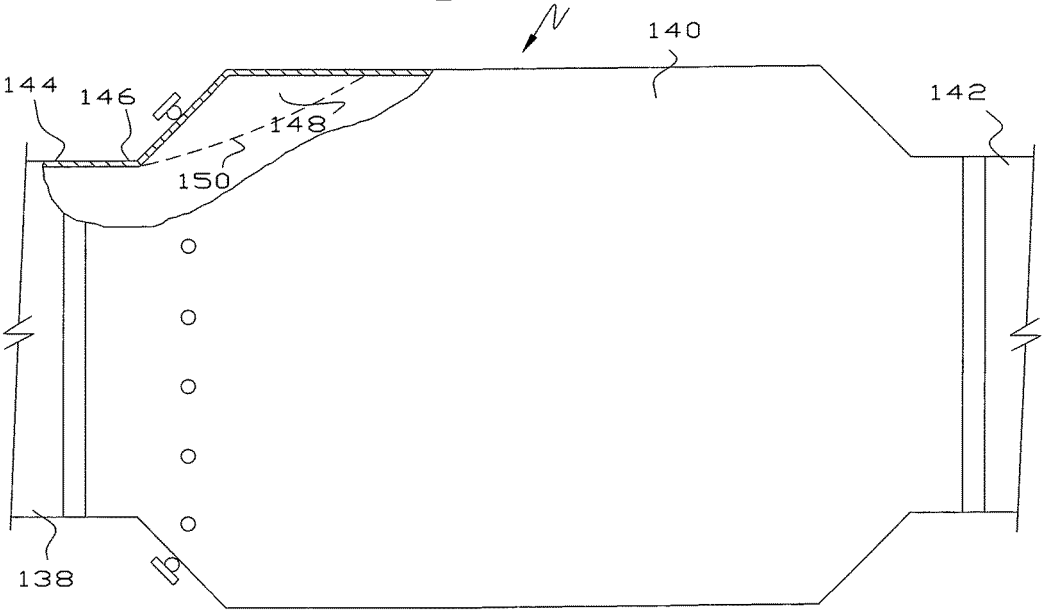
FIG. 7 is a broken view of another embodiment of a duct and nozzle array.

Referring to Figure 7, there is illustrated another approach to create a dead air space into which water spray may be directed. A round or pipe shaped duct 136 is located between the gin stands and the battery condenser and includes an inlet 138, an enlarged section 140 and an outlet 142. Because of the increase in diameter of the pipe wall 144 at a location 146, a dead air space 148 is created where the lint detaches from the wall 144 along a line 150 downstream of the location 146. The dead air space 148 is roughly annular because the duct 136 is round.

Figure 8:
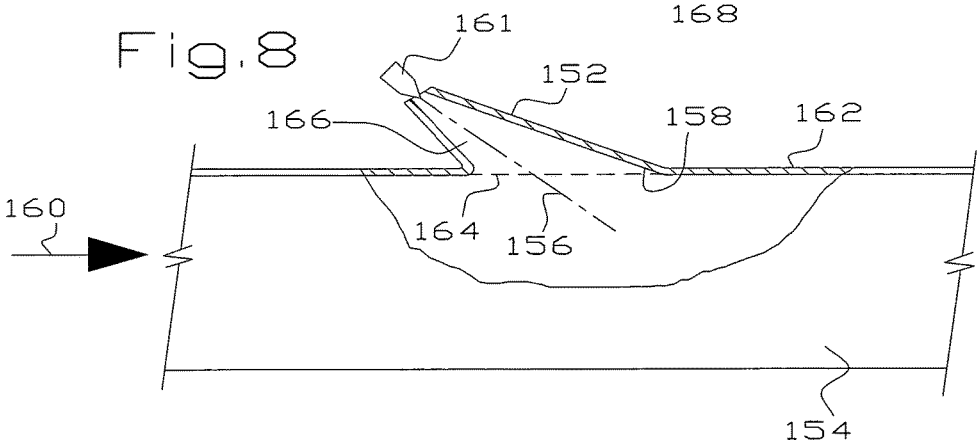
FIG. 8 is a broken view of another embodiment of a duct and nozzle assembly.

It will be apparent that many different approaches may be devised to create a dead air space in a duct of a pneumatic conveyor, as by the provision of a compartment 152 opening into a duct 154 as shown in FIG. 8, particularly when an axis 156 of the opening 158 is inclined in the direction 160 of flow thereby producing a venturi like affect to reduce the pressure adjacent the end of the nozzle assembly 161. It will be seen that lint flow in the duct 154 detaches from the wall 162 along a line or zone 164 creating a dead air space 166 inside the duct 154. It will be apparent there are many other ways to create a dead air space adjacent a nozzle. For example, vanes or other obstructions upstream of a nozzle may be used to divert the air/lint stream away from the wall of a straight duct and thereby create a dead air space into which the nozzle sprays.

Figure 9:
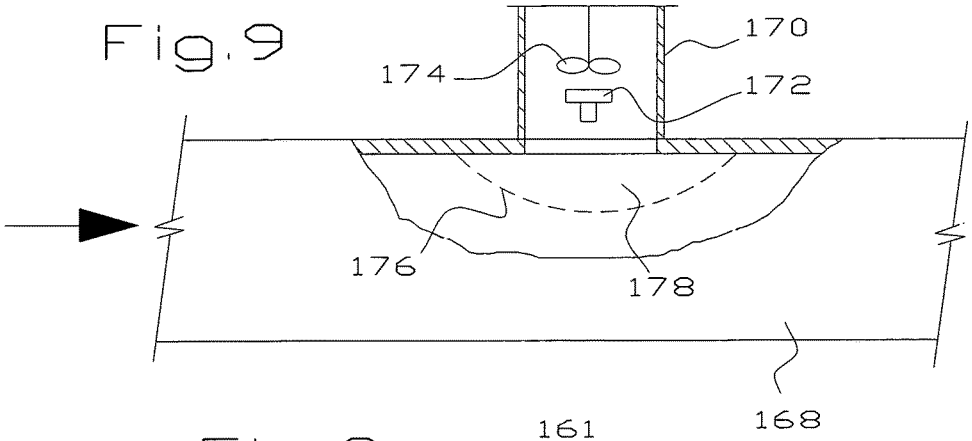
FIG. 9 is a broken view of another embodiment of a duct and nozzle assembly.

Some of the effects of a dead air space can be created by forcibly blowing air into a duct 168 as shown in FIG. 9. A conduit 170 opens into the duct 168 and houses a nozzle assembly 172 and a fan 174 driven by a motor (not shown). Air blowing into the duct 168 depresses lint flowing through the duct 168 along a line or zone 176 to create a zone or area 178 which allows spray from the nozzle assembly 172 to spread out in much the same manner that a dead air zone allows spray to spread out and increase the fraction of cotton fibers contacted by water. Because of the direction of flow in the duct 168, the zone 178 may typically be skewed in the downstream direction.

Figure 10:
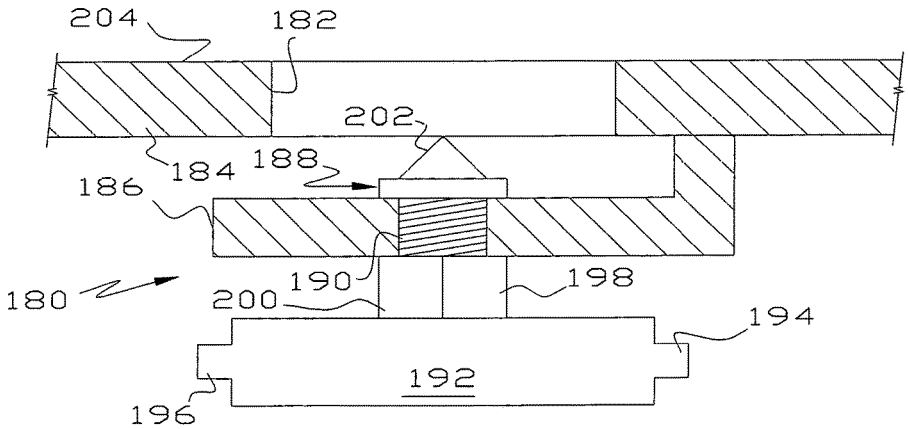
FIG. 10 is a cross-sectional view of a nozzle assembly illustrating its connection with a duct.

Referring to FIG. 10, there is illustrated an exemplary nozzle assembly 180 mounted on or adjacent an opening 182 in a duct 184 by a bracket 186 affixed to the duct 184 in any convenient manner. A nozzle 188 may preferably be removably attached to the bracket 186 as by mating threads 190. A manifold 192 attaches to the bracket 186 and/or nozzle 188 in any suitable manner and includes an air connection 194 and a water connection 196 separately connected to the nozzle 188 through fittings 198, 200. The end 202 of the nozzle 188 will be seen to be outboard, or spaced from, the interior wall 204 of the duct 184 to reduce the accumulation of cotton lint or debris on the nozzle 188. The opening 182 allows outside ambient air to flow into the duct 184 around the nozzle end 202 thereby cleaning the nozzle end 202 and dislodging any cotton lint or debris attempting to collect on the nozzle 188.

It may be desirable to employ filters to remove particles in the same range or larger than the water droplets emitting from the spray nozzles. To this end, referring to FIG. 4, a filter 202 may be employed in the air line 64 to remove particles from the air stream. Similarly, a filter 204 may be employed in the water line 62 to remove particles from the water source. The filters 202, 204 may preferably remove particles of any desired size, such as 1-20 micron, thereby eliminating two sources of dust in the baled cotton. Commercially available filters down to one micron are available and may be used. Five micron filters have proved successful.

It may be desirable to employ a heater in the water supply to minimize the effects of operating in abnormally cold climates or during an abnormally cold time of the year. To this end, a heater 206 may be incorporated in the water supply line 62.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereafter claimed.

I claim:

1. A cotton gin comprising at least one gin stand, a battery condenser receiving cotton lint from the at least one gin stand and including a device to separate cotton lint from propulsion air, a duct and equipment configured to pneumatically transport cotton lint from the at least one gin stand to the battery condenser, a bale press, a lint slide delivering a cotton batt from the battery condenser to the bale press, a source of water and at least one spray nozzle configured to receive water from the source and emit droplets, the nozzle being configured to direct the droplets onto the pneumatically transported cotton lint, downstream of the at least one gin stand and upstream of the device in the battery condenser.

2. The cotton gin of claim 1 wherein the cotton lint comprises fibers of a diameter in the range of 7-22 microns and wherein the spray nozzle being configured to deliver water droplets having a diameter in the range of 5-25 microns.

3. The cotton gin of claim 2 wherein the spray nozzle is configured to deliver water droplets of 8-12 microns in diameter.

4. The cotton gin of claim 1 further comprising a taggant delivery system including the source of water and taqqant in the source of water, the nozzle being configured to emit taqqant-water droplets directed toward the pneumatically conveyed cotton lint.

5. The cotton gin of claim 4 wherein the taggant is DNA.

6. The cotton gin of claim 1 wherein the spray nozzle is configured to deliver spray into the duct between the at least one gin stand and the battery condenser.

7. The cotton gin of claim 1 wherein the cotton gin includes a lint cleaner, upstream of the battery condenser, receiving cotton lint from the gin stand and wherein the spray nozzle is configured to emit liquid water droplets directed into the duct between the lint cleaner and the battery condenser.

8. The cotton gin of claim 6 wherein the duct being configured to create a zone where cotton lint flow has disengaged from a duct wall, the spray nozzle being configured to emit water droplets directed into the zone.

9. The cotton gin of claim 8 wherein the duct includes an elbow having an inlet, a hatch access and an outlet at an angle to the inlet other than 180° , the zone being located adjacent the hatch access.

10. The cotton gin of claim 8 wherein the duct includes a section having an inlet, a section of increased cross-sectional area and an outlet, the zone being located adjacent a junction of the inlet and section of increased cross-sectional area.

11. The cotton gin of claim 8 wherein the duct includes a compartment opening into the duct at an angle inclined to the direction of flow, the zone being located adjacent an intersection of the compartment and the duct.

12. The cotton gin of claim 8 wherein the duct is configured to produce pressure in the zone less than atmospheric pressure exterior to the duct and the duct includes an opening allowing the movement of air in a flow path from the exterior of the duct into the interior, the nozzle being mounted outboard of an interior of the duct in the air flow path to reduce material collecting on the nozzle.

13. The cotton gin of claim 8 wherein the duct includes a conduit opening into the duct, a nozzle in the conduit, a fan in the conduit and configured to deliver air into the duct and create the zone.

14. A method of marking cotton lint in a cotton gin with a taggant comprising pneumatically conveying cotton lint, in a duct, away from gin stands toward a battery condenser having a device to separate cotton lint from propulsion air and creating a spray of droplets of a liquid solution of the taggant from a nozzle and directing the droplets into the duct onto the cotton lint at a location between the gin stands and the battery condenser device while the cotton lint is being pneumatically conveyed toward the battery condenser.

15. The method of claim 14 wherein directing the droplets into the duct is conducted between a lint cleaner, downstream of the gin stands, and the battery condenser.

16. The method of claim 14 wherein the conveying step comprises pneumatically conveying cotton fibers having a width in the range of 7-22 microns and the step of directing droplets into the duct comprises spraying water in a range of 5-25 microns onto the cotton lint.

17. The method of claim 14 wherein the solution is a water solution.

18. The method of claim 14 further comprising the step of creating a dead air space open to an interior of the duct and the step of directing droplets into the duct comprises spraying the solution droplets into the dead air space.

19. The method of claim 14 further comprising the step of creating a zone internally of the duct where cotton flow through the duct separates from a duct wall and the step of directing droplets into the duct comprises spraying the solution droplets into the zone.

20. A method of spraying water on cotton lint in a cotton gin comprising pneumatically conveying cotton lint, in a duct, away from gin stands toward a battery condenser having a device to separate cotton lint from propulsion air and spraying water droplets from a nozzle into the duct onto the cotton lint at a location between the gin stands and the battery condenser device while the cotton lint is being pneumatically conveyed toward the battery condenser.

21. A cotton gin comprising at least one gin stand, a battery condenser receiving cotton lint from the at least one gin stand and including a device to separate cotton lint from propulsion air, a duct and equipment configured to pneumatically transport cotton lint through the duct from the at least one gin stand to the battery condenser, a bale press and a lint slide delivering a cotton batt from the battery condenser to the bale press and at least one spray nozzle configured to emit water droplets and direct the water droplets into the duct onto the pneumatically transported cotton lint at a location between the at least one gin stand and the battery condenser.

* * * * *